US006910698B2

(12) United States Patent
Turner et al.

(10) Patent No.: US 6,910,698 B2
(45) Date of Patent: Jun. 28, 2005

(54) SKATEBOARDS

(75) Inventors: Daryl V. Turner, Scottsdale, AZ (US); Peter Gantner, Fountain Hills, AZ (US)

(73) Assignee: Strategic Focus International, Inc., Scottsdale, AZ (US)

( * ) Notice: Subject to any disclaimer, the term of this patent is extended or adjusted under 35 U.S.C. 154(b) by 0 days.

(21) Appl. No.: 10/374,213

(22) Filed: Feb. 25, 2003

(65) Prior Publication Data

US 2003/0160411 A1 Aug. 28, 2003

Related U.S. Application Data

(60) Provisional application No. 60/360,311, filed on Feb. 26, 2002.

(51) Int. Cl.[7] ..... B62M 1/00

(52) U.S. Cl. ..... 280/87.042

(58) Field of Search ..... 280/87.041, 87.042, 280/87.05, 809, 842, 11.27; 180/180, 181; D21/765

(56) References Cited

U.S. PATENT DOCUMENTS

| | | | | | |
|---|---|---|---|---|---|
| 3,695,626 | A | * | 10/1972 | Alexander | 280/28.14 |
| 3,982,766 | A | * | 9/1976 | Budge | 280/1 |
| 4,093,252 | A | | 6/1978 | Rue | |
| 4,114,913 | A | | 9/1978 | Newell et al. | |
| 4,127,282 | A | | 11/1978 | Gorlach et al. | |
| 4,153,245 | A | | 5/1979 | McCoy | |
| 4,160,554 | A | * | 7/1979 | Cooney | 280/87.042 |
| 4,181,316 | A | | 1/1980 | Brand et al. | |
| 4,184,693 | A | * | 1/1980 | Whitmarsh | 280/11.28 |
| 4,323,258 | A | * | 4/1982 | Culpeper | 280/7.12 |
| 4,323,261 | A | | 4/1982 | Samuelson | |
| 4,411,442 | A | | 10/1983 | Rills | |
| 4,521,029 | A | * | 6/1985 | Mayes | 280/7.14 |
| 4,817,974 | A | | 4/1989 | Bergeron | |
| 5,232,154 | A | | 8/1993 | Jenkins et al. | |
| 5,372,384 | A | * | 12/1994 | Smith | 280/842 |
| 5,458,351 | A | | 10/1995 | Yu | |
| 5,584,787 | A | | 12/1996 | Guidry | |
| 5,718,438 | A | | 2/1998 | Cho | |
| 5,743,391 | A | | 4/1998 | Hsiao | |
| 5,795,277 | A | | 8/1998 | Bruntmyer | |
| 5,826,895 | A | * | 10/1998 | Bradfield | 280/87.042 |
| 5,915,707 | A | | 6/1999 | Steffen | |
| 6,059,062 | A | | 5/2000 | Staelin et al. | |
| D430,635 | S | * | 9/2000 | Danache | D21/765 |
| 6,145,857 | A | * | 11/2000 | Bernstein | 280/87.042 |
| 6,343,803 | B1 | | 2/2002 | Johnston | |
| 2004/0155420 | A1 | * | 8/2004 | Pierron | 280/87.042 |

FOREIGN PATENT DOCUMENTS

| | | | |
|---|---|---|---|
| DE | 19634604 | * | 3/1998 |
| EP | 1096980 | * | 5/2001 |
| SU | 5022328 | * | 8/1993 |

* cited by examiner

*Primary Examiner*—Bryan Fischmann
(74) *Attorney, Agent, or Firm*—Blakely, Sokoloff, Taylor & Zafman LLP

(57) ABSTRACT

Skateboards that incorporate a curved or arched board with wheel trucks and a cross member that may be repositioned on the board, with the board either in an arched upward or arched downward orientation. The cross member may have projections on its underside for locating with respect to a rail, such as at 90 degrees or 45 degrees with respect to the rail for sliding along the rail. The removable trucks may be replaced with such alternates as roller blade trucks and ice skate blade type of "truck." Also disclosed is safety clothing suitable for use when skateboarding or in other activities. The clothing has pockets in the inside thereof to removeably receive cushioning or energy absorbing material, typically in sheet form, such as closed cell foam, so as to be invisible to the casual observer, but to offer substantial protection to body parts such as hips, knees and the like. Various embodiments and embellishments are disclosed.

4 Claims, 11 Drawing Sheets

FIG. 1A
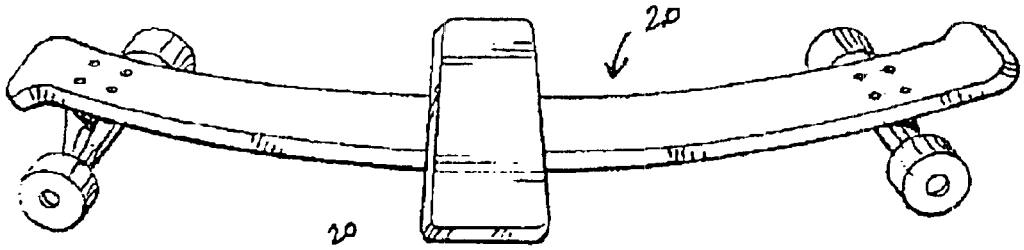
FIG. 1B
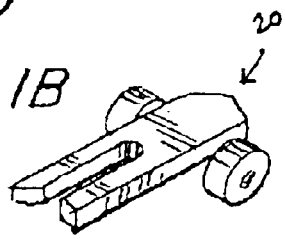
FIG. 1D
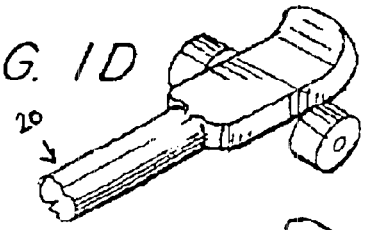
FIG. 1C
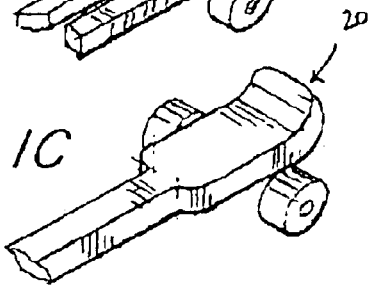
FIG. 1E
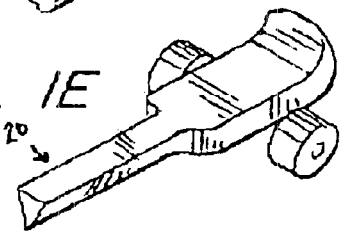
FIG. 2
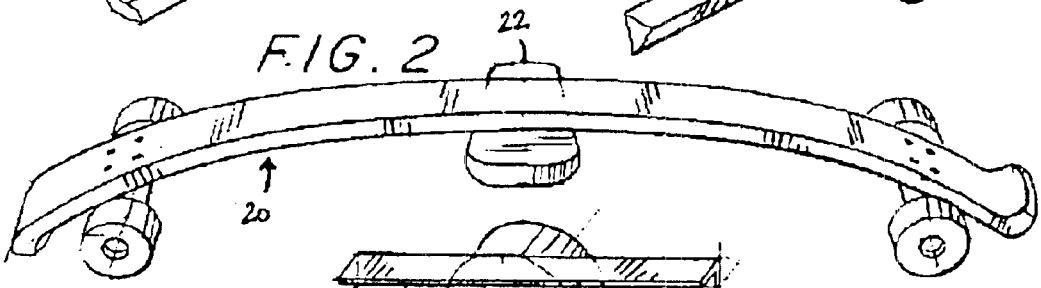
FIG. 3A
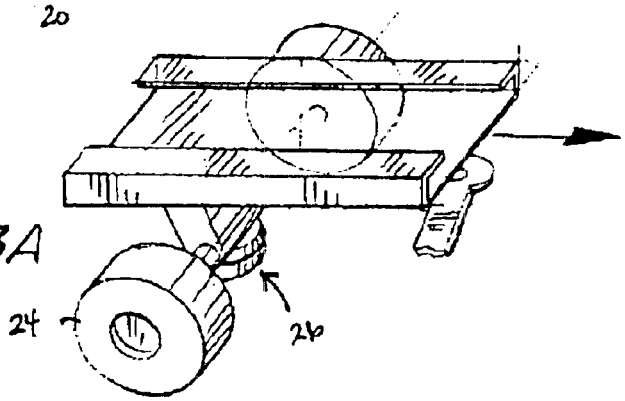
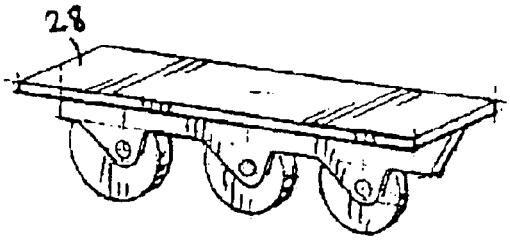
FIG. 3B
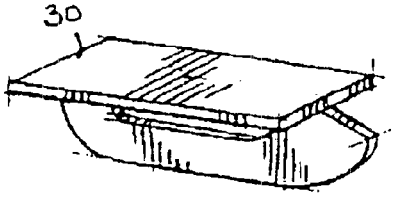
FIG. 3C

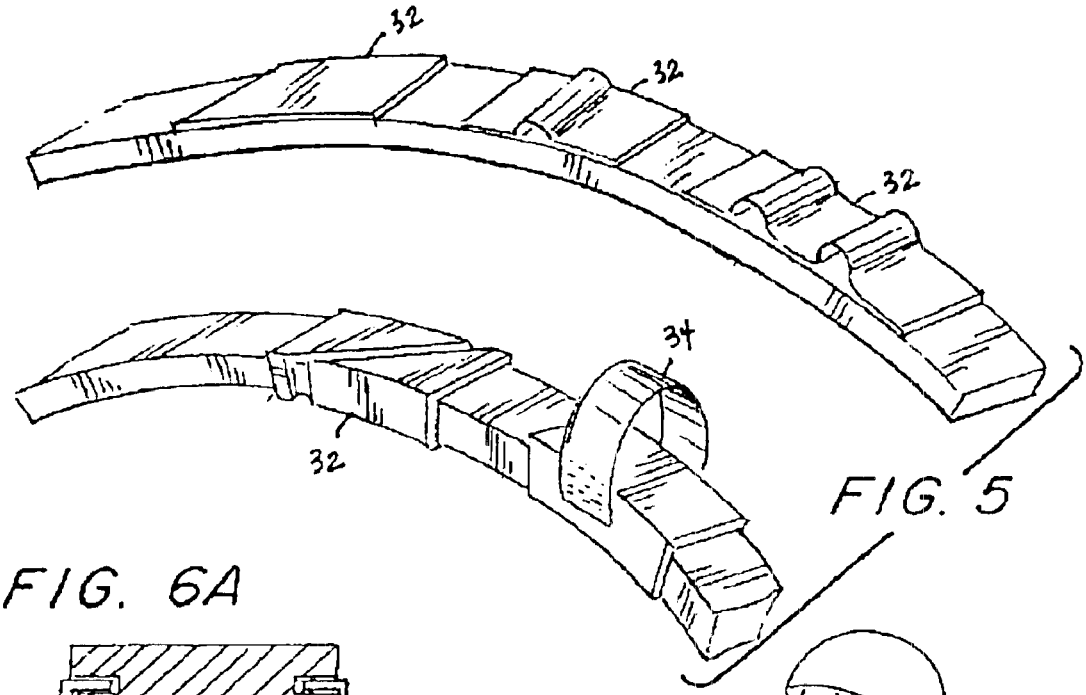
FIG. 5
FIG. 6A
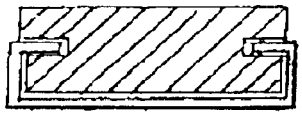
FIG. 6B
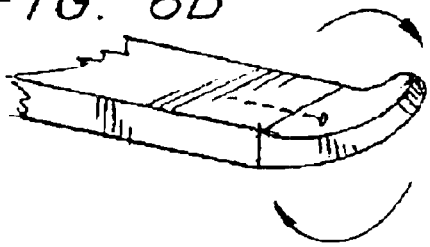
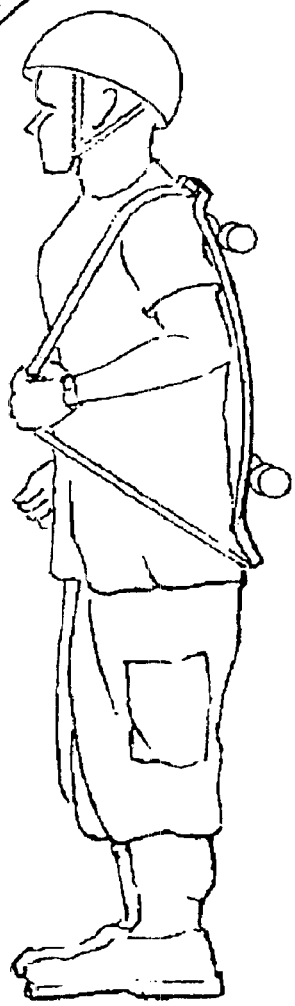
FIG. 7

SKATEBOARDS

CROSS-REFERENCE TO RELATED APPLICATION

This application claims the benefit of U.S. Provisional Patent Application No. 60/360,311 filed Feb. 26, 2002.

BACKGROUND OF THE INVENTION

1. Field of the Invention

The present invention relates to the field of skateboards.

2. Prior Art

Scooters, skates and skateboards have been known to the toy, sports and entertainment industry for many years, with the history of scooters and skates going back many years.

Both skateboards and scooters come in a variety of styles. Scooters may have small or large wheels, both hand and foot brakes and have a steering column extending from the platform to enable the rider to steer the scooter. Motion is achieved either by the foot of the scooter rider, pushing against the ground to propel the scooter forward, or more recently, by a small motor to power the scooter.

Skateboards are another adaptation of the scooter with fixed front and back pairs of wheels without a steering mechanism, where a rider propels himself along with the board by pushing against the ground, and using skills similar to those acquired by learning to ride a bike, is able to control and steer the board with their body weight and movements.

Skateboards and the riders of them have, over the past few years, propelled the sport into an art form, where many maneuvers are performed that appear to defy gravity.

Skateboards have changed very little in basic shape or form over the years, the main changes being in the front of the skateboard with a point, and the back of the skateboard with an upward turned flair, or an increase in length for carving and wheel size.

BRIEF SUMMARY OF THE INVENTION

The skateboard of the present invention offers the rider a new riding experience to expand the range of maneuvers that can be performed with a board that is strong and flexible, to offer new maneuvers, with and without wheels. The skateboard incorporates a curved or arched board with wheel trucks and a cross member that may be repositioned on the board, with the board either in an arched upward or arched downward orientation. The cross member may have projections on its underside for locating with respect to a rail, such as at 90 degrees or 45 degrees with respect to the rail for sliding along the rail. The removable trucks may be replaced with such alternates as roller blade trucks and ice skate blade type of "truck." Also disclosed is safety clothing suitable for use when skateboarding or in other activities. The clothing has pockets in the inside thereof to removeably receive cushioning or energy absorbing material, typically in sheet form, such as closed cell foam, so as to be invisible to the casual observer, but to offer substantial protection to body parts such as hips, knees and the like. Various embodiments and embellishments are disclosed.

BRIEF DESCRIPTION OF THE DRAWINGS

FIGS. 1A through 1E illustrates one embodiment of the present invention.

FIG. 2 illustrates the embodiment of the invention of FIG. 1 with the board turned over.

FIGS. 3A through 3D illustrate various forms of "trucks" that may be used with any embodiment of the present invention.

FIG. 5 shows the addition of one or more plates on either side of the Rail Board.

FIG. 6A illustrates an alternative method of attaching a component to the board.

FIG. 6B illustrates how the end kick plate may be rotated to allow the end plate to be reversed.

FIG. 7 illustrates how a traveling strap may be attached to the board.

FIG. 8B illustrates how, in an exemplary embodiment, a soft plastic compound 36 that is co-molded or inserted into the wheels.

FIG. 9A shows how the truck may be mounted to a board, on a medium like a Gel that allows the board to tilt.

DETAILED DESCRIPTION OF THE PREFERRED EMBODIMENTS

Figure 3D:
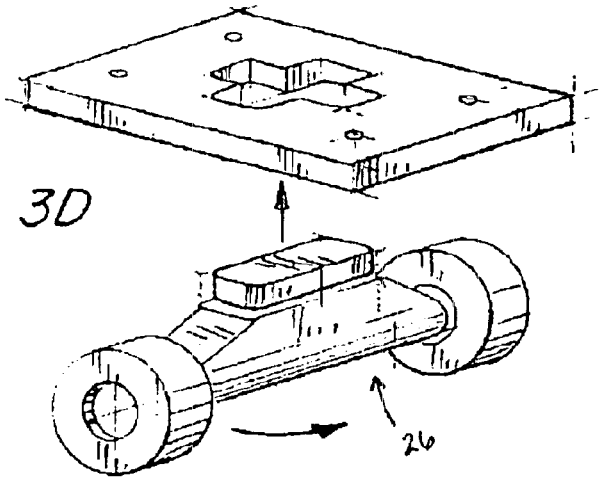

The rail board 20 may vary in width, the preferred embodiment being a narrow board as shown in FIGS. 1A through 1E. The narrow board may be of various geometric shapes, and may incorporate single or multiple fingers—such fingers may be used to hold various attachments to the board. The board may be flared out to create a platform at one or both ends.

FIG. 2 shows the rail board in the shape of an arch; the arch gives the rail board two unique properties, "spring" and "strength." The rail board may be used with the arch facing up (FIG. 2) or down (FIG. 1A).

In addition, near the center of the board, a cross member 22 (FIG. 2) may be added. The cross member may be gripped by the riders feet or hands, or may be used by the rider in various ways to control the performance of the board.

The board may have various width options to alter the handling characteristics of the rail board. The board width options can be combined with the available axle widths to make the riding experience more challenging.

The wheels 24 as shown in FIG. 3A, attached to the "truck" (axle assembly) 26, may be anchored to the board via screws or bolts, and the board may have a series of holes located along the board to accommodate the rider changing the position of the truck or trucks to accomplish various riding conditions. The truck wheel assembly 26 may also be slid along the board via a sliding system (FIG. 3A) and locked into place by a cam lock. Also the trucks may be changed to accommodate other forms of locomotion such as ice blades 30 or roller blades 28 as shown in FIGS. 3B and 3C.

Alternatively, a removable truck may be mounted into a base plate or screwed onto the board, whereas the truck when unlocked or twisted may be removed, to enable the board to be used without the truck assembly (FIG. 3D).

A turn up or alternative turn down at the end of the rail board may be provided (FIGS. 1A and 2), to enable the rider to flick the board with their feet, or grip with their hands in various maneuvers. The turn up may be able to be removed, if not required, or to allow the truck assembly to be slid on and off the rail board.

Figure 4A:
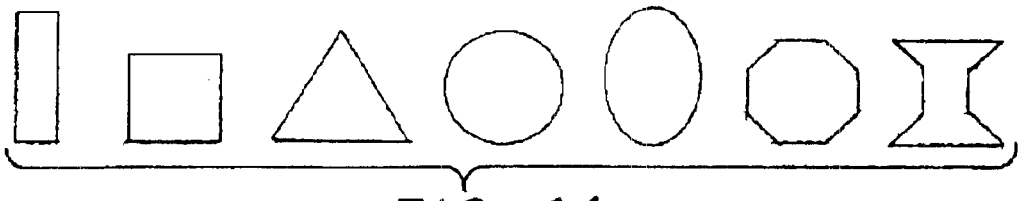
FIG. 4A illustrates various exemplary cross sections of the board.
Figure 4B:
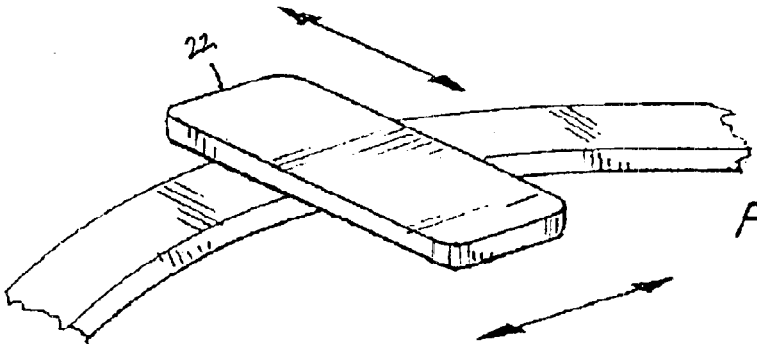
FIG. 4B illustrates the possible adjustability in the position of the cross member on the board.
Figure 4C:
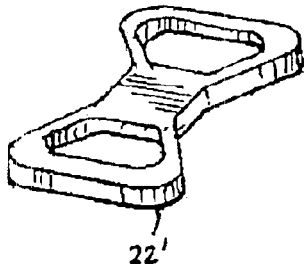
FIG. 4C illustrates a possible variation in configuration of the cross member.

The centerboard may be of various shapes some examples are shown, as shown in FIG. 4A. The centerpiece may be moved to various positions along the board, and may be offset upon its X & Y-axis as shown in FIG. 4B. More than one centerboard may be used. Hand and foot holes may be provided in the centerpiece 22', as in FIG. 4C. The ends or sides maybe turned up or down to allow the rider to complete more feats.

FIG. 5 shows the addition of one or more plates 32 on either side of the Rail Board. The plates 32 may be made of various metals or plastics. The plates 32 may have a substantially flat surface, or the plates may have indentations or protrusions. The rider can use the indentations or protrusions to perform various maneuvers, such as sliding along an edge or pipe. A plate 32 may be located on either side of the board, or on the edge or both, and may be located in various positions along the length of the board. One or more plates 32 may be on the board at any one time. The attachment may include a strap 34 to allow the rider to hook his fingers or shoes into.

FIG. 6A shows an alternative method of attaching a component to the board. The attachment is secured into a grove of various geometric dimensions. FIG. 6B shows how the end kick plate may be rotated to allow the end plate to be reversed.

FIG. 7 shows how a traveling strap may be attached, the strap may include a storage area for storing tools, lubricant, etc.

Figure 8A:
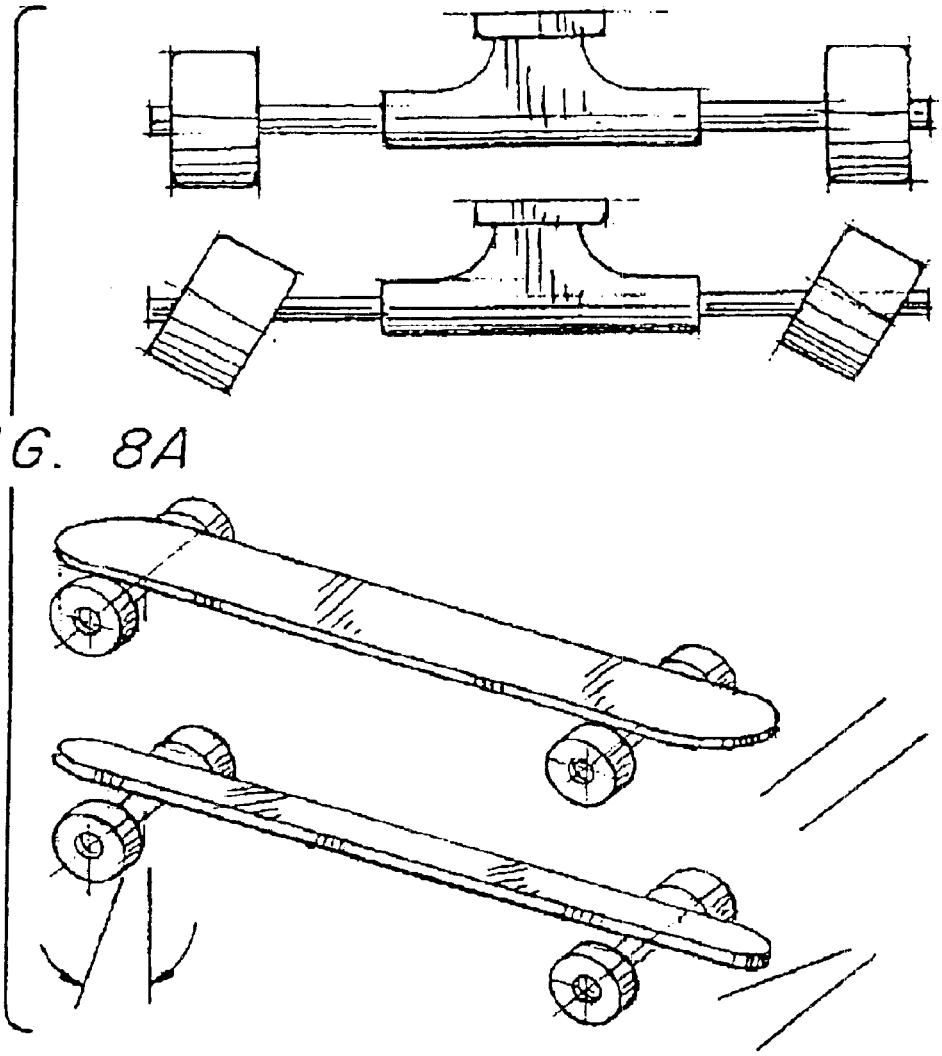
FIG. 8A shows how the wheels can be given the ability to independently tilt.
Figure 8B:
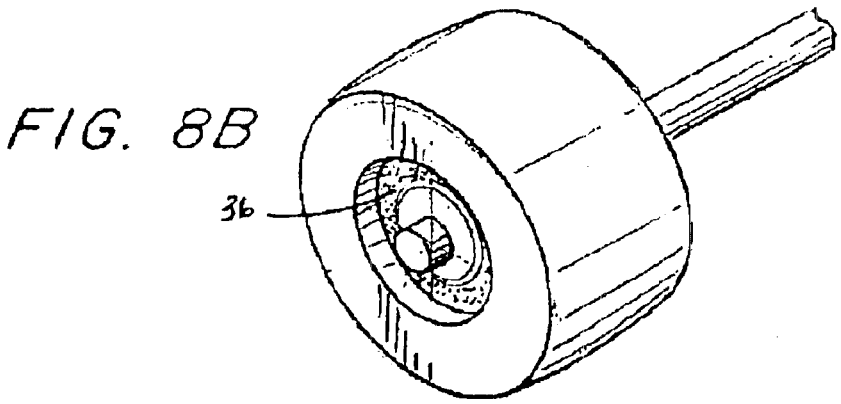
FIG. 8B shows one embodiment of a soft plastic compound 36 that is co-molded or inserted into the wheel, so that when the rider moves their weight the foot surface of the rail tilts.

FIG. 8A shows how the wheels can be given the ability to independently tilt. FIG. 8B shows one embodiment of a soft plastic compound 36 that is co-molded or inserted into the wheel, so that when the rider moves their weight the foot surface of the rail tilts.

Figure 9A:
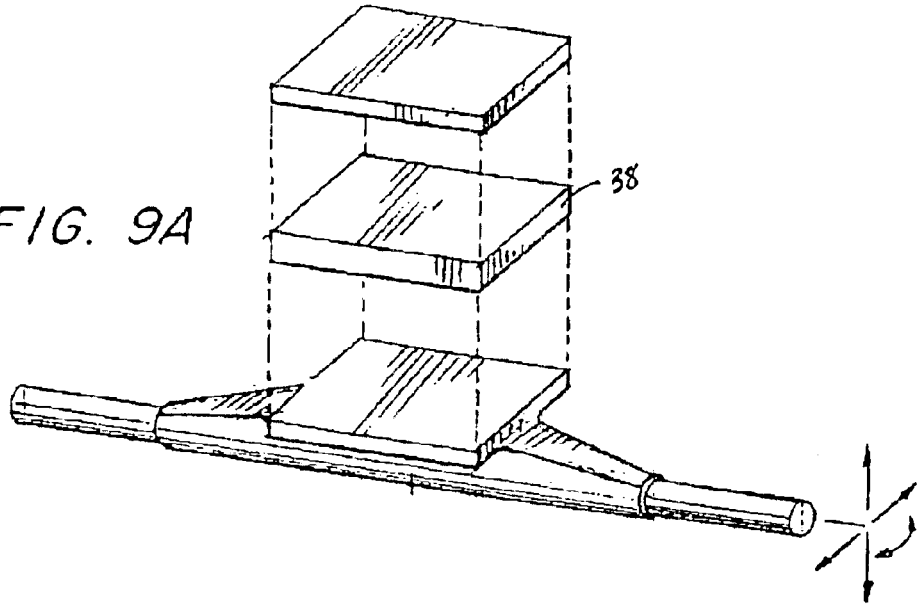
FIG. 9A shows how the truck may be mounted to a board, on a medium like a soft plastic that allows the board to tilt.
Figure 9B:
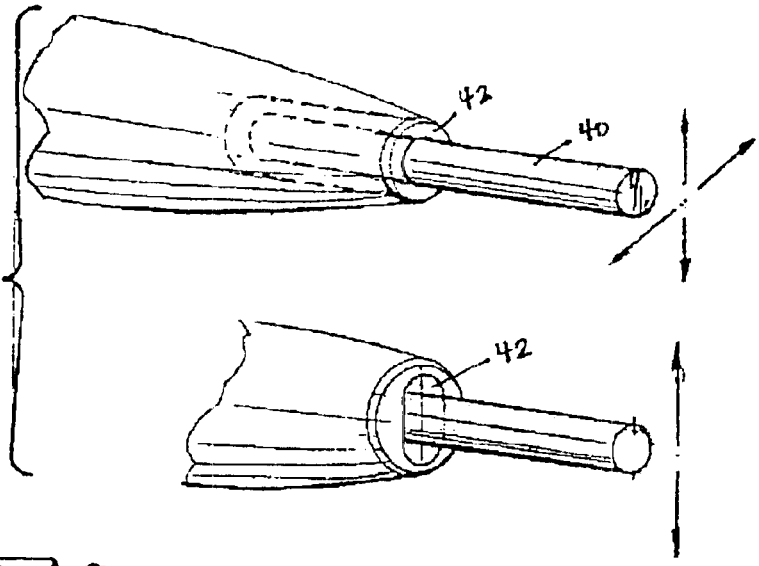
FIG. 9B shows how the axle mounted into the truck maybe encapsulated in a medium that allows the axle to move within the truck housing.

FIG. 9A shows how the truck may be mounted to a board, on a medium 38 like a soft plastic that allows the board to tilt. FIG. 9B shows how the axle mounted into the truck may be encapsulated in a medium that allows the axle to move within the truck housing.

Figure 9C:
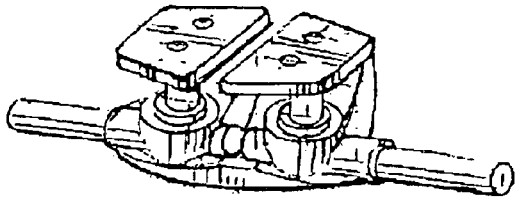
FIG. 9C shows how the trucks upper portion may be split into two sections, each with its own independent suspension system.

FIG. 9C shows how the trucks upper portion may be split into two sections, each with its own independent suspension system, to allow the wheels to operate in an independent way. The above truck and wheel assemblies may be used individually or one or more features may be combined.

The soft plastic surrounds in the above Figures. above can be housed in various shaped housings. By way of example, an oblong geometric shape, would allow the movement of the wheels in a controlled manner.

Figure 10A:
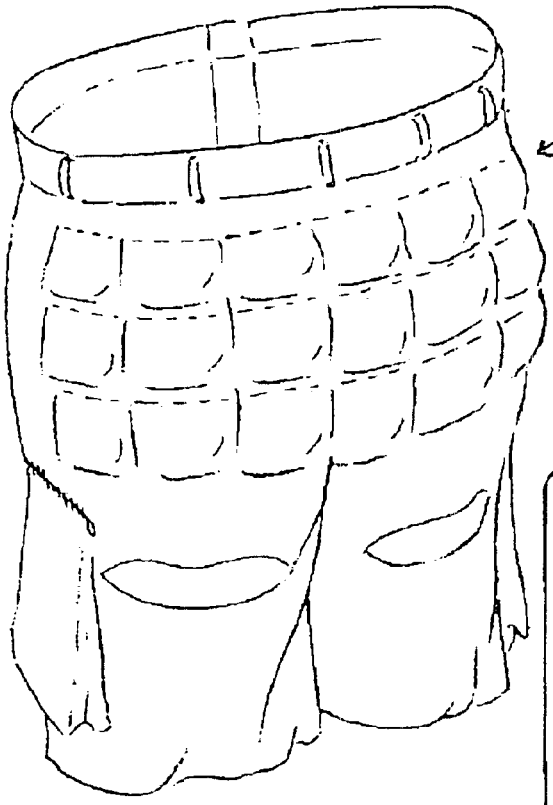
FIG. 10A shows how an item of clothing 44 may incorporate a series of pockets located in strategic areas where the body needs protection from a fall.
Figure 10B:
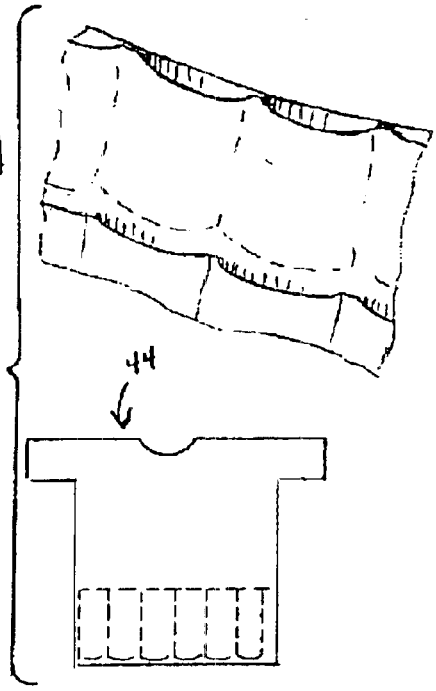
FIG. 10B shows pockets that are sewn into the clothing.
Figure 10C:
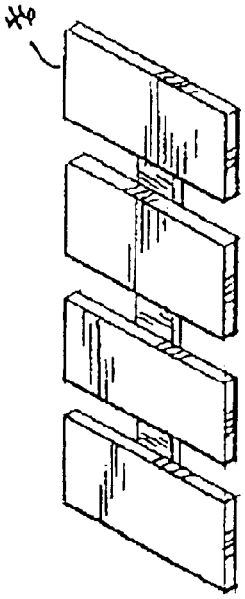
FIG. 10C shows an impact absorbing material 46 that is assembled into sections.

FIG. 10A shows how an item of clothing 44 may incorporate a series of pockets located in strategic areas whore tho body needs protection from a fall. FIG. 10B shows pockets that are sewn into the clothing, typically on the inside of the clothing so as to not be visible. FIG. 10C shows an impact absorbing material 46 that is assembled into sections, to allow the person wearing the clothing to perform in the activity, the protective pads being unobtrusive, yet protecting the person in the event of a fall.

The skateboard may be manufactured out of a variety of materials including, but not restricted to wood, metal composite and plastics. The surface of the board may have a non-slip surface.

Figure 11:
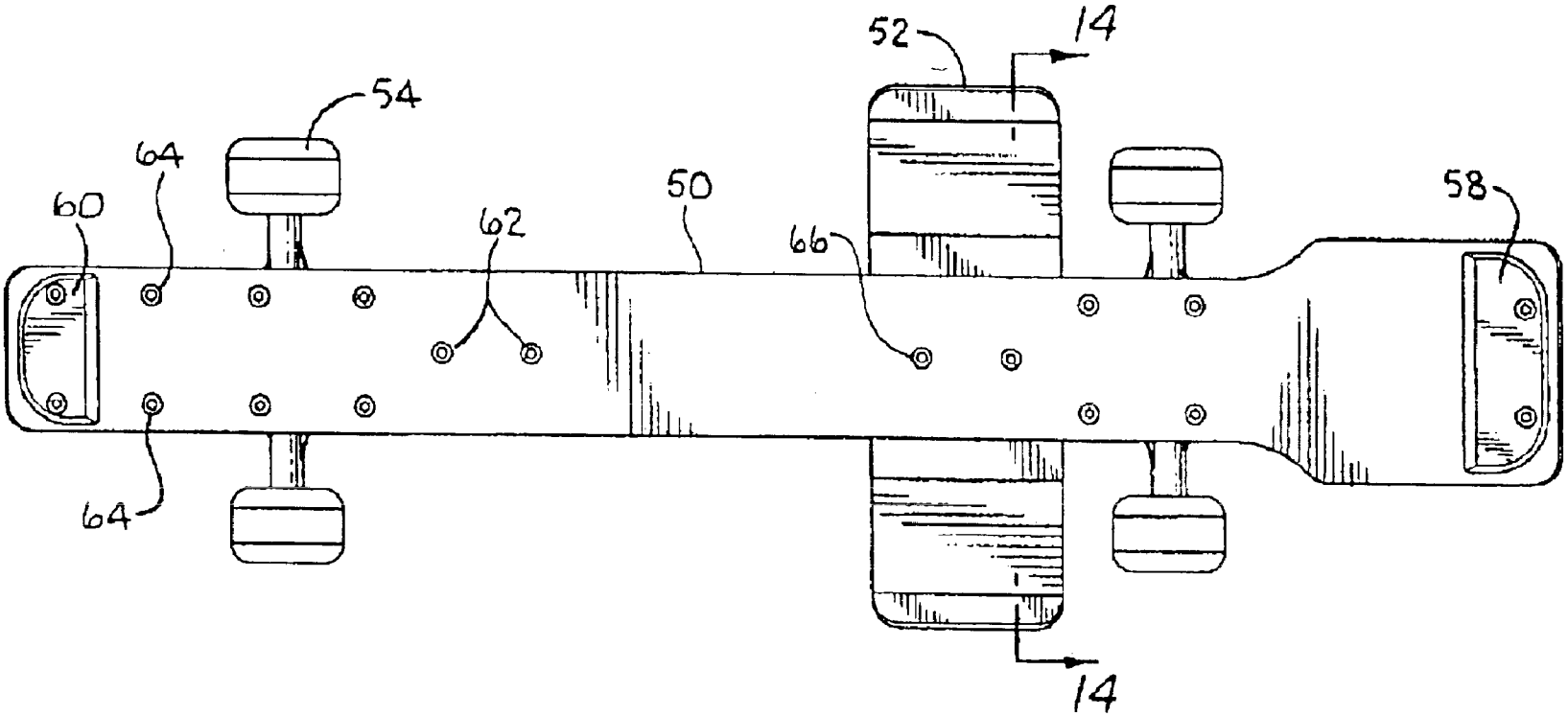
FIGS. 11 and 12 are a top view and a side view, respectively, of another embodiment of a skateboard in accordance with the present invention.
Figure 12:
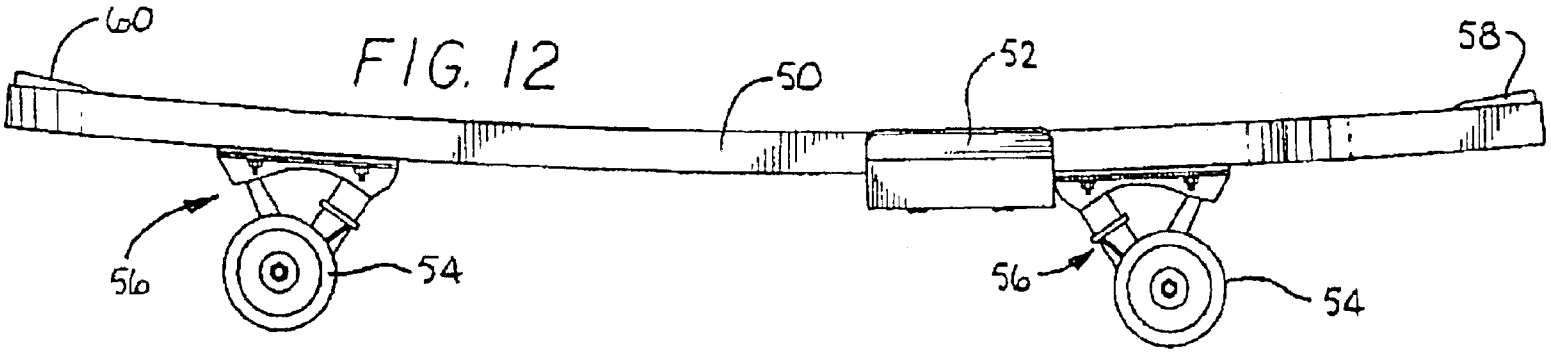

Now referring to FIGS. 11 and 12, a top view and a side view of another embodiment of a skateboard in accordance with the present invention may be seen. Visible in these views is the board 50, crosspiece 52, wheels 54 on trucks 56 and end kicks 58 and 60. As may be seen in these Figures, the trucks, crossmember and end kick are bolted to the board 50 (other removable fasteners may be used as desired), so as to be removable if desired. In addition, however, the board 50 includes additional bolt hole patterns, 62 and 64 for relocation of the crossmember 52 and at least one of the trucks 54. In this embodiment, the trucks may be conventional skateboard trucks with the crossmember 52 being fabricated from any of various materials, such as metal, fiberglass or other composite material or high strength injection molded plastic.

The board 50 is this embodiment is intentionally curved, as in other embodiments, and itself may be fabricated from various materials, though in a preferred embodiment is a laminated 15 ply maple board of substantial thickness to withstand the demanding use such a board will be subjected to by experienced and inexperienced riders alike.

Figure 13:
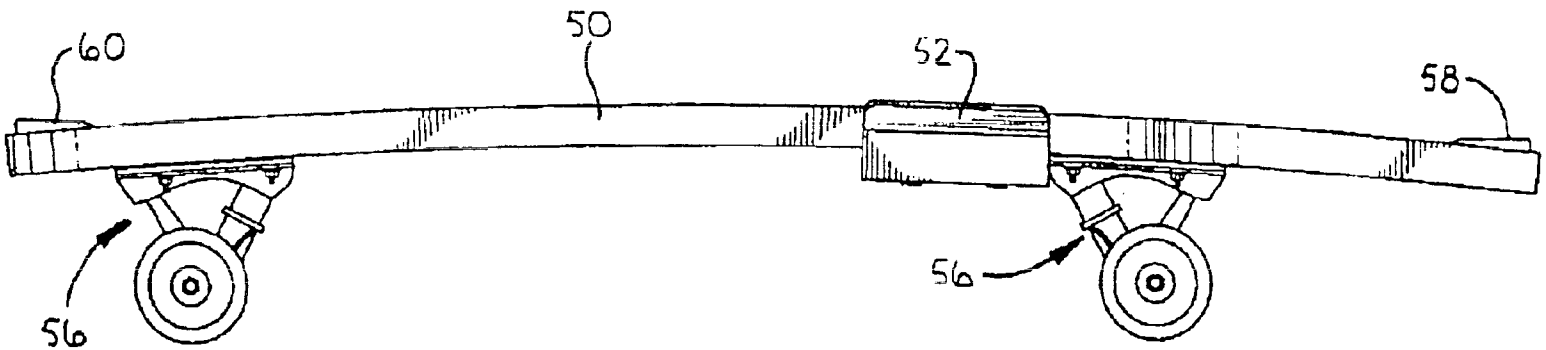
FIG. 13 is a side view of the skateboard of FIGS. 11 and 12 with the board 50 turned over.
Figure 14:
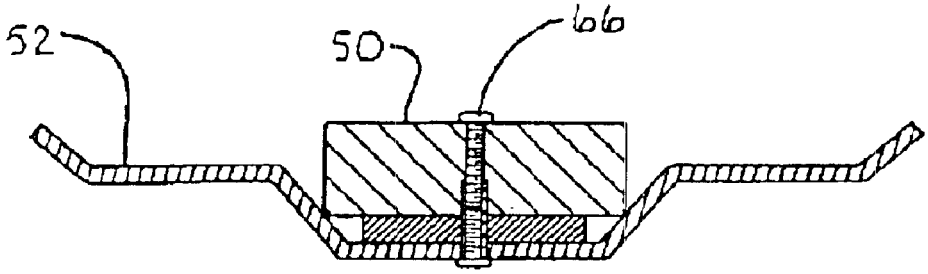
FIG. 14 is a cross section taken along lines 14—14 of FIG. 11 showing the exemplary mounting of the cross member to the board.
Figure 15:
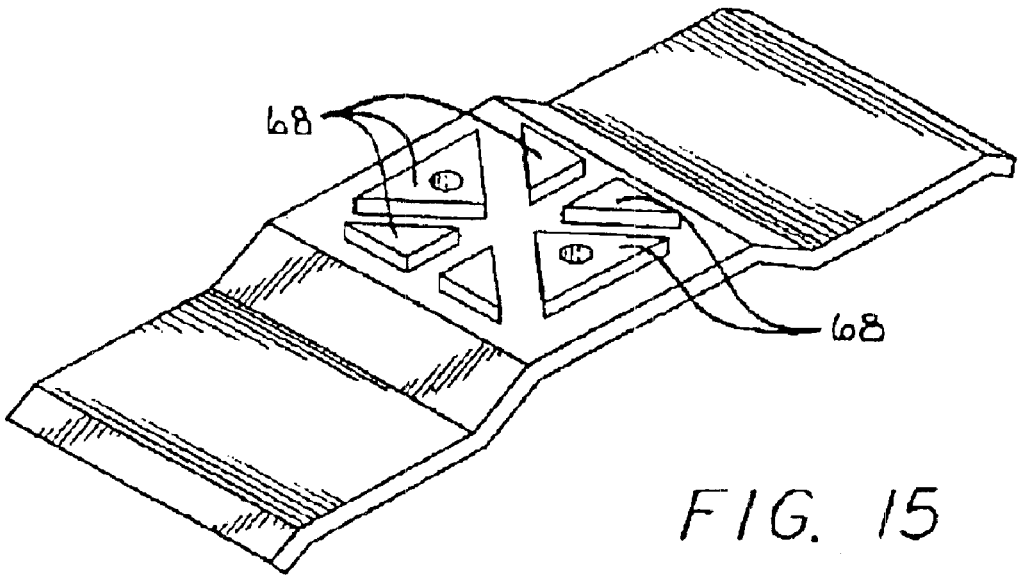
FIG. 15 is a perspective view of the bottom of an exemplary cross member.

Now referring to FIG. 13, a side view of the skateboard with the board 50 turned over may be seen. This may be readily accomplished by removing the bolts and remounting the trucks 56, the crossmember 52 and the end kicks 58 and 60. Also as may be seen in FIG. 13, the forward truck has been relocated to a new forward position to give a different riding experience. The crossmember 52, itself, is simply bolted in position by bolts 66, as may be seen in both FIGS. 11 and 14. The bottom of the crossmember 52 may be provided with downward projecting protrusions 68 which provide a guide for sliding on a pipe or rail, either with the board at a 90° angle with respect to the rail or at a 45° angle with respect to the rail, as shown in FIG. 15.

Figure 16:
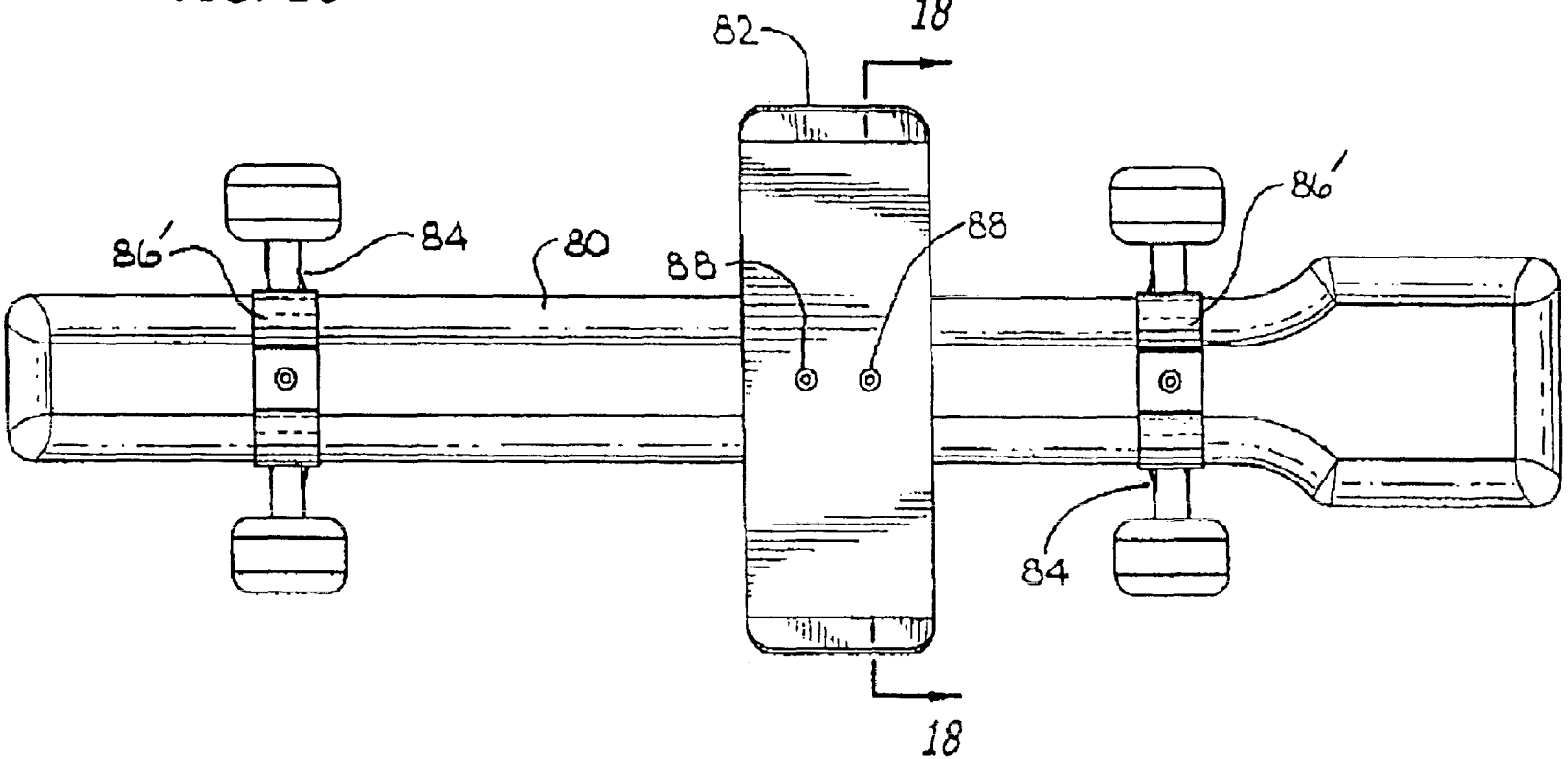
FIG. 16 is a top view of still another embodiment of the present invention.
Figure 17:
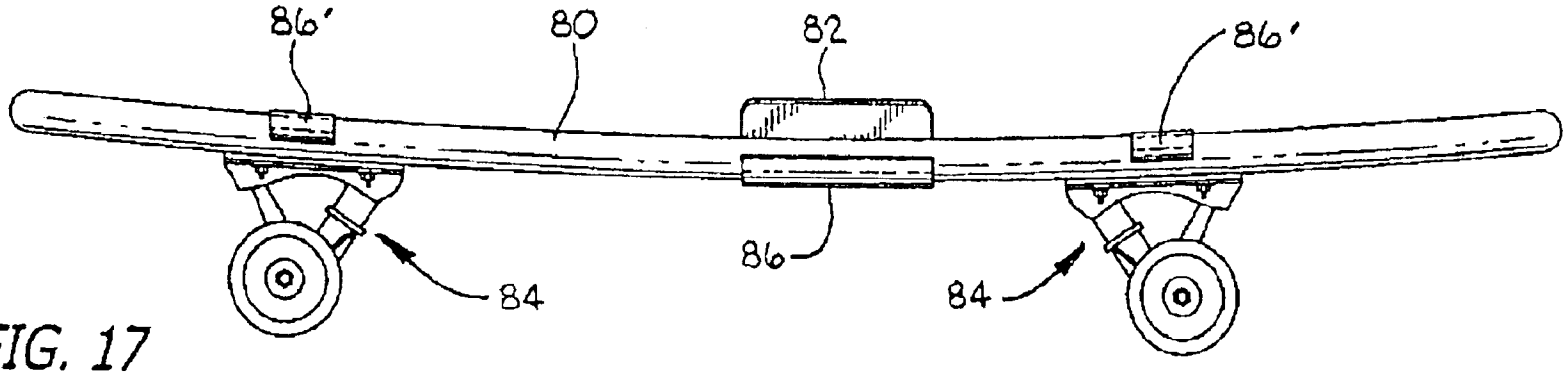
FIG. 17 is a side view of the embodiment of FIG. 16.
Figure 18:
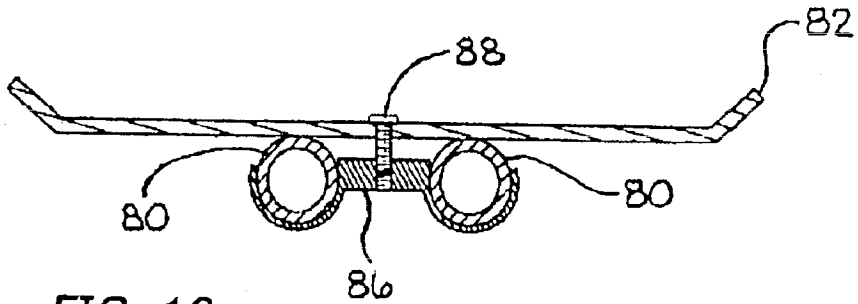
FIG. 18 is a cross section taken along line 18—18 of FIG. 16.

Now referring to FIGS. 16 and 17, a still further embodiment of the present invention may be seen. In this embodiment, the "board" 80 is fabricated from tube stock, preferably one or more pieces of aluminum tubing welded together and bent to form the arched board shown. While circular tubing is shown, square or other shapes may also be used. The cross member 82 and the trucks 84 clamp to the parallel longitudinal tubes at substantially any position along the parallel tubes, with the tubular board arching upward or downward as desired. An exemplary clamping arrangement is shown in FIG. 18. As shown therein the cross member 82 is clamped to the tubes using a clamp member 86 and bolts 88. Similar clamp members 86' (FIGS. 16 and 17) may be used to clamp the trucks at the desired positions. In such an embodiment, it is preferred to make one end larger than the other as shown, though this is not essential in this or any of the other embodiments. Also, one effect of the tubular construction is to form a board having a longitudinal slot, though the same slotted construction can be achieved with a wood, composite or other board, as in FIG. 1B.

While certain preferred embodiments of the present invention have been disclosed herein, such disclosure is only for purposes of understanding the exemplary embodiments and not by way of limitation of the invention. It will be obvious to those skilled in the art that various changes in form and detail may be made in the invention without departing from the spirit and scope of the invention as set out in the full scope of the following claims.

What is claimed is:

1. A skateboard comprising:

a board having a plurality of hole patterns in the board, the board having a center section and first and second ends, the board being curved along its center section with the first end being wider than the center section;

first and second wheel trucks; and, a cross member;

the first and second wheel trucks and the cross member being coupled to the board by removable fasteners;

the plurality of hole patterns in the board defining a plurality of predetermined positions at which the cross member and at least one truck may be rigidly fastened to either side of the board by the removable fasteners so that the board curves up or down.

2. The skateboard of claim 1 wherein the removable fasteners are bolts.

3. The skateboard of claim 1 wherein the removable fasteners are screws.

4. The skateboard of claim 1 further comprising end kicks coupled to the board by removable fasteners so as to be coupleable to either side of the board.

* * * * *